US008342344B2

(12) United States Patent
Livingston

(10) Patent No.: US 8,342,344 B2
(45) Date of Patent: Jan. 1, 2013

(54) METHOD AND APPARATUS FOR PROVIDING A POSITIVE PRESSURE IN THE HEADSPACE OF A PLASTIC CONTAINER

(75) Inventor: Darren D. Livingston, Denver, CO (US)

(73) Assignee: Amcor Rigid Plastics USA, Inc., Ann Arbor, MI (US)

( * ) Notice: Subject to any disclaimer, the term of this patent is extended or adjusted under 35 U.S.C. 154(b) by 839 days.

(21) Appl. No.: 12/351,491

(22) Filed: Jan. 9, 2009

(65) Prior Publication Data

US 2009/0179032 A1 Jul. 16, 2009

Related U.S. Application Data

(60) Provisional application No. 61/020,633, filed on Jan. 11, 2008, provisional application No. 61/105,241, filed on Oct. 14, 2008.

(51) Int. Cl.
*B65D 53/00* (2006.01)

(52) U.S. Cl. ..... 215/349; 215/275; 215/276; 215/214; 220/228; 220/254.8

(58) Field of Classification Search ..... 215/262, 215/349, 270, 274, 275, 276, 214, 218; 220/288, 220/254.8, 233, 234, 327, 240, 361
See application file for complete search history.

(56) References Cited

U.S. PATENT DOCUMENTS

| | | | |
|---|---|---|---|
| 2,005,349 | A | 6/1935 | Raney |
| 2,449,014 | A | 9/1948 | Shaffer |
| 2,484,083 | A | 10/1949 | Findley |
| 2,551,937 | A | 5/1951 | Gallagher |
| 3,189,210 | A | 6/1965 | Heisler |
| 3,557,986 | A | 1/1971 | Poole, Jr. |
| 3,627,171 | A | 12/1971 | Kaplow |
| 3,628,704 | A | 12/1971 | Corsette |
| 3,672,114 | A | 6/1972 | Sacks |
| 3,733,771 | A | 5/1973 | Megowen |
| 3,810,343 | A | 5/1974 | Palomo |
| 3,833,142 | A | 9/1974 | Owen |
| 4,016,996 | A | 4/1977 | Aichinger et al. |
| 4,076,142 | A | 2/1978 | Naz |
| 4,122,964 | A | 10/1978 | Morris |
| 4,133,462 | A | 1/1979 | Lindström |
| 4,135,635 | A | 1/1979 | Fujii et al. |
| 4,174,784 | A | 11/1979 | Hartung |

(Continued)

FOREIGN PATENT DOCUMENTS

EP 1400283 A2 3/2004

(Continued)

OTHER PUBLICATIONS

International Preliminary Report on Patentability for International (PCT) Patent Application No. PCT/US2009/030645, mailed Jul. 22, 2010.

(Continued)

*Primary Examiner* — Mickey Yu
*Assistant Examiner* — Kareen Rush
(74) *Attorney, Agent, or Firm* — McDermott Will & Emery LLP

(57) ABSTRACT

The present invention is directed to a method and apparatus for accommodating the pressure decrease of the fluid in a hot-filled plastic container.

25 Claims, 19 Drawing Sheets

U.S. PATENT DOCUMENTS

| | | | | |
|---|---|---|---|---|
| 4,255,457 | A | | 3/1981 | Collias |
| 4,279,351 | A | | 7/1981 | Vertes |
| 4,480,424 | A | | 11/1984 | Seldon |
| 4,542,029 | A | | 9/1985 | Caner et al. |
| 4,627,986 | A | | 12/1986 | Bardsley |
| 4,655,355 | A | | 4/1987 | Turoff et al. |
| 4,685,273 | A | | 8/1987 | Caner |
| 4,722,450 | A | | 2/1988 | Mario |
| 4,765,498 | A | | 8/1988 | Rafferty |
| 4,798,302 | A | | 1/1989 | Killestijn |
| 4,799,598 | A | | 1/1989 | McFadyen |
| 4,836,398 | A | | 6/1989 | Leftault |
| 4,872,570 | A | | 10/1989 | Harding |
| 4,883,190 | A | | 11/1989 | Thomas, Jr. |
| 4,896,789 | A | | 1/1990 | Federspiel |
| 4,993,572 | A | | 2/1991 | Ochs |
| 4,998,638 | A | * | 3/1991 | Kawamata ..... 220/626 |
| 5,004,126 | A | | 4/1991 | Klesius |
| 5,064,082 | A | | 11/1991 | Lombardi |
| 5,096,078 | A | * | 3/1992 | McQueeny ..... 215/231 |
| 5,100,009 | A | | 3/1992 | Thompson et al. |
| 5,305,900 | A | | 4/1994 | Maguire et al. |
| 5,413,230 | A | | 5/1995 | Folter et al. |
| 5,433,331 | A | | 7/1995 | Morini |
| 5,458,252 | A | | 10/1995 | Logel |
| 5,460,283 | A | | 10/1995 | Macartney et al. |
| 5,499,729 | A | | 3/1996 | Greenwood |
| 5,622,865 | A | * | 4/1997 | Kayal et al. ..... 435/304.1 |
| 5,743,420 | A | | 4/1998 | Löffler et al. |
| 5,853,096 | A | | 12/1998 | Bartur et al. |
| 6,044,994 | A | | 4/2000 | Miller |
| 6,050,435 | A | | 4/2000 | Bush et al. |
| 6,068,154 | A | | 5/2000 | Grabher |
| 6,141,970 | A | | 11/2000 | Molzahn |
| 6,182,850 | B1 | | 2/2001 | Marbler |
| 6,193,094 | B1 | | 2/2001 | Diamond |
| 6,202,870 | B1 | | 3/2001 | Pearce |
| 6,502,710 | B1 | | 1/2003 | Bösl et al. |
| 6,540,099 | B2 | | 4/2003 | Lu |
| 6,581,792 | B1 | | 6/2003 | Limanjaya |
| 6,626,310 | B2 | | 9/2003 | Taha |
| 6,637,321 | B2 | | 10/2003 | Wang |
| 6,688,081 | B2 | | 2/2004 | Boyd |
| 6,769,559 | B2 | | 8/2004 | Ziegler et al. |
| 6,772,894 | B1 | | 8/2004 | Druitt et al. |
| 6,976,669 | B2 | | 12/2005 | Van Zijll Langhout et al. |
| 7,055,713 | B2 | | 6/2006 | Rea |
| 7,117,654 | B2 | | 10/2006 | Danks |
| 7,503,453 | B2 | | 3/2009 | Cronin et al. |
| 7,537,133 | B2 | | 5/2009 | Naesje |
| 7,591,398 | B2 | | 9/2009 | Pritikin |
| 2002/0162839 | A1 | | 11/2002 | Stull et al. |
| 2003/0057176 | A1 | * | 3/2003 | Kitterman et al. ..... 215/351 |
| 2004/0265447 | A1 | | 12/2004 | Raniwala |
| 2005/0173370 | A1 | | 8/2005 | Odet et al. |
| 2005/0269337 | A1 | | 12/2005 | McGrath |
| 2006/0032831 | A1 | | 2/2006 | Major |
| 2006/0138163 | A1 | | 6/2006 | Danks |
| 2006/0278603 | A1 | | 12/2006 | Takashima et al. |
| 2007/0045321 | A1 | | 3/2007 | Fox |
| 2007/0080130 | A1 | | 4/2007 | Trent et al. |
| 2007/0131644 | A1 | | 6/2007 | Melrose |
| 2007/0221604 | A1 | | 9/2007 | Hakim |
| 2007/0228058 | A1 | | 10/2007 | Brown |
| 2008/0073348 | A1 | | 3/2008 | Pritikin |
| 2008/0083693 | A1 | | 4/2008 | Gottlieb |
| 2008/0128380 | A1 | | 6/2008 | Denner |
| 2008/0173612 | A1 | | 7/2008 | Renz |
| 2008/0237176 | A1 | | 10/2008 | Pillado |
| 2008/0272084 | A1 | | 11/2008 | Lohrman |
| 2009/0101620 | A1 | | 4/2009 | O'Brien |

FOREIGN PATENT DOCUMENTS

| | | | |
|---|---|---|---|
| FR | 2630408 | A3 | 4/1988 |
| NL | 9000215 | | 8/1991 |
| WO | WO 98/06631 | | 2/1998 |
| WO | WO0010884 | A1 | 3/2000 |
| WO | WO 2006/053013 | | 5/2006 |

OTHER PUBLICATIONS

International Search Report for International (PCT) Patent Application No. PCT/US2009/030645, mailed Mar. 11, 2009.

Written Opinion for International (PCT) Patent Application No. PCT/US2009/030645, mailed Mar. 11, 2009.

Supplementary European Search Report dated Jun. 26, 20112 from Corresponding European Patent Application No. 09701397.3.

US 7,562,510, 07/2009, Abercrombie, III (withdrawn)

* cited by examiner

METHOD AND APPARATUS FOR PROVIDING A POSITIVE PRESSURE IN THE HEADSPACE OF A PLASTIC CONTAINER

This application claims the benefit of pending Provisional Patent Application Ser. No. 61/105,241, filed Oct. 14, 2008 and pending Provisional Patent Application Ser. No. 61/020,633, filed Jan. 11, 2008, the entire disclosures of each application being incorporated by reference.

FIELD OF THE INVENTION

The present invention relates generally to a closure for an associated container, and more specifically to a rotatable cap closure with one or more sealing features for creating a positive pressure or accommodating a pressure drop in a plastic container associated with the occurrence of a vacuum, thereby generally preventing the deformation of the container.

BACKGROUND OF THE INVENTION

Internally threaded, plastic cap closures have found widespread application for use in connection with hot-fill plastic containers by virtue of their low manufacturing costs and sealing performance. In a conventional hot-fill process, a hot beverage product is introduced into the plastic container, typically filling most of the container. The fluid is heated during a pasteurization or sterilization process to remove bacteria or other contamination. The plastic container is hermetically sealed with a cap while the product is still hot. Since the beverage product is typically not filled to the top of the container, a headspace of air is provided between the liquid enclosed within the plastic container and an inner surface of the cap. The temperature of the liquid varies from a high of about 185 degrees Fahrenheit, the typical hot-fill temperature, to about 40 degrees Fahrenheit, the typical refrigeration temperature. A change in temperature, from hot to cold, decreases the internal pressure of the sealed container and creates a vacuum within the container primarily as a result of the thermal contraction of the liquid in the container. This decrease in pressure can distort and/or deform the geometry of the container if the container cannot structurally support the pressure difference between the external ambient pressure and the lower internal pressure of the container. Deformation of the container generally pushes the fluid upwardly and decreases the headspace volume. For example, for a typical 16-ounce container, thermal contraction equates to roughly 3% of the total liquid volume, or 0.9 cubic inches when the stored contents are cooled from about 185° to about 40° F.

Current containers are engineered to collapse at specific locations or are reinforced with vacuum panels and/or flexible bases to compensate for the vacuum. Vacuum-reactive mechanisms are very efficient to maintain a balanced pressure and keep the remaining structural geometry of the container from collapsing. Vacuum panels, however, are difficult to mold. Further, labeling of the container is difficult because containers employing raised and/or recessed vacuum panels possess reduced surface area. The reduction of surface area also restricts the ornamental design of the label, restricts the placement of the label, and often leads to unattractive wrinkling of the label.

Embodiments of the present invention described herein are directed to an apparatus and method for accommodating the pressure decrease associated with hot filling and subsequently cooling a liquid stored in a plastic container. By addressing the vacuum created within the container, vacuum panels may be eliminated or reduced.

SUMMARY OF THE INVENTION

Accordingly, it is one aspect of the present invention to provide a method and apparatus for accommodating a pressure change in a plastic bottle that occurs during hot-filling, capping, and subsequently cooling a beverage container. In one embodiment of the present invention a plastic closure cap for containers is provided that define a headspace. When the container and beverage is cooled, the headspace air pressure reduces to a level less than the external pressure felt by the container, i.e., a vacuum is created. A diaphragm is associated with the cap to eliminate or significantly reduce the vacuum in the container. Thus, the container is able to accommodate any pressure differential between the external pressure and the reduced pressure in the container without substantially deforming.

It is another aspect of the embodiments of the present invention to provide a closure cap having one or more sealing features associated with the cap. When the cap is positioned on a container neck, the sealing features hermetically seal the cap to the container. As the cap is tightened onto the neck of the container, the sealing mechanism is driven downward and simultaneously compresses the air in the headspace. The increase in pressure is sufficient to compensate the reduction in pressure that occurs when the container is cooled. Distortions generally associated with the pressure decrease are thus avoided.

In another aspect of embodiments of the present invention to provide a plastic cap having a "slider ring" is positioned within an annular void within the cap. The slider ring can be a polymeric material having oxygen barrier properties, such as, but not limited to polypropylene, thermoplastic elastomers (TPE), or co-polymers thereof. The slider ring also may include one or more sealing features, such as a cylindrical or semi-cylindrical circumferential features. When the cap is positioned on a container neck, the slider ring hermetically seals the cap to the container, and creates a seal between the cap and the internal surface of the neck of the container. Air within the container is prevented from escaping as the cap is tightened onto the container neck which pressurizes the trapped air in the headspace. The pressure increase is designed to accommodate the pressure decrease experienced during cooling of the stored contents, thus eliminating or significantly reducing any pressure drop or vacuum in the container.

It is yet another aspect of embodiments of the present invention is to provide a plastic cap closure having a flexible bellows. The flexible bellows extend within the neck of the container to reduce or eliminate the vacuum. During attachment of the closure to the neck of the container, the bellows is compressed to force air positioned therein into the container which creates a pressure increase within the container. The pressure increase is sufficiently large such that when the container is cooled, a pressure decrease sufficient enough to distort the container will not form.

Still yet another aspects of embodiments of the present invention is to provide a closure cap having one or more sealing features within the cap and/or a method of applying the cap to a container which limits the head pressure during the sealing process. More specifically, when sealed under excessive pressure, the container can expand and/or reform. Thus, one embodiment of the present invention reduces the headspace pressure to substantially prevent bursting of the container. An optimal headspace pressure is contemplated that is less than the burst pressure of the container and less than the container distortion pressure. For example, the closure cap may at least partially vent the air entrained in the headspace to maintain the optimal headspace pressure, or can alternatively vent during removal of the cap to allow easier removal of the cap from the container. Alternatively, the capping process can be conducted to achieve the optimal pressure, as for example, by capping at an optimally preferred temperature and/or with an optimally preferred headspace volume.

It is yet another aspect of embodiments of the present invention to employ a movable diaphragm that accommodates the pressure decrease. The diaphragm includes a head that transitions from a first position of use, adjacent to an inner surface of the cap, to a second position of use, within the neck of the container, to compensate any pressure decrease or increase. In order to allow for the head of the diaphragm to move downwardly, air is communicated from outside the container into a space between the head of the diaphragm and the inner surface of the cap. The air is prevented from contacting the contents of the container by a non-permeable portion of the diaphragm. When the cap is removed from the container, the head of the diaphragm, preferably, transitions automatically upwardly to engage the inner surface of the cap.

It is still yet another aspect of the present invention to provide a container that is easy to label or add indicia thereto. By omitting the need for vacuum panels, embodiments of the present invention provide greater label contact area. The containers, thus, are designed to be more distinctive in shape without requiring about 50% of the visible surface area being dedicated to vacuum panels. Furthermore, containers of the present invention are designed around structural integrity instead of collapse, thus resulting in lighter bottles and material savings.

Although these aspects of the invention have been described separately, one of skill in the art will appreciate that some or all variations of the inventions may be combined. Further, the Summary of the Invention is neither intended not should be construed as being representative of the full extent and scope of the present invention. The present invention is set forth in various levels of detail in the Summary of the Invention and as well in the attached drawings and in the detailed description of the invention and not limitation as to the scope of the present invention is intended by either the inclusion or non-inclusion of elements, components, etc. in this Summary of the Invention. Additional aspects of the present invention will be come more readily apparent from the Detailed Description, preferably when taken together with the drawings.

Figure 1:
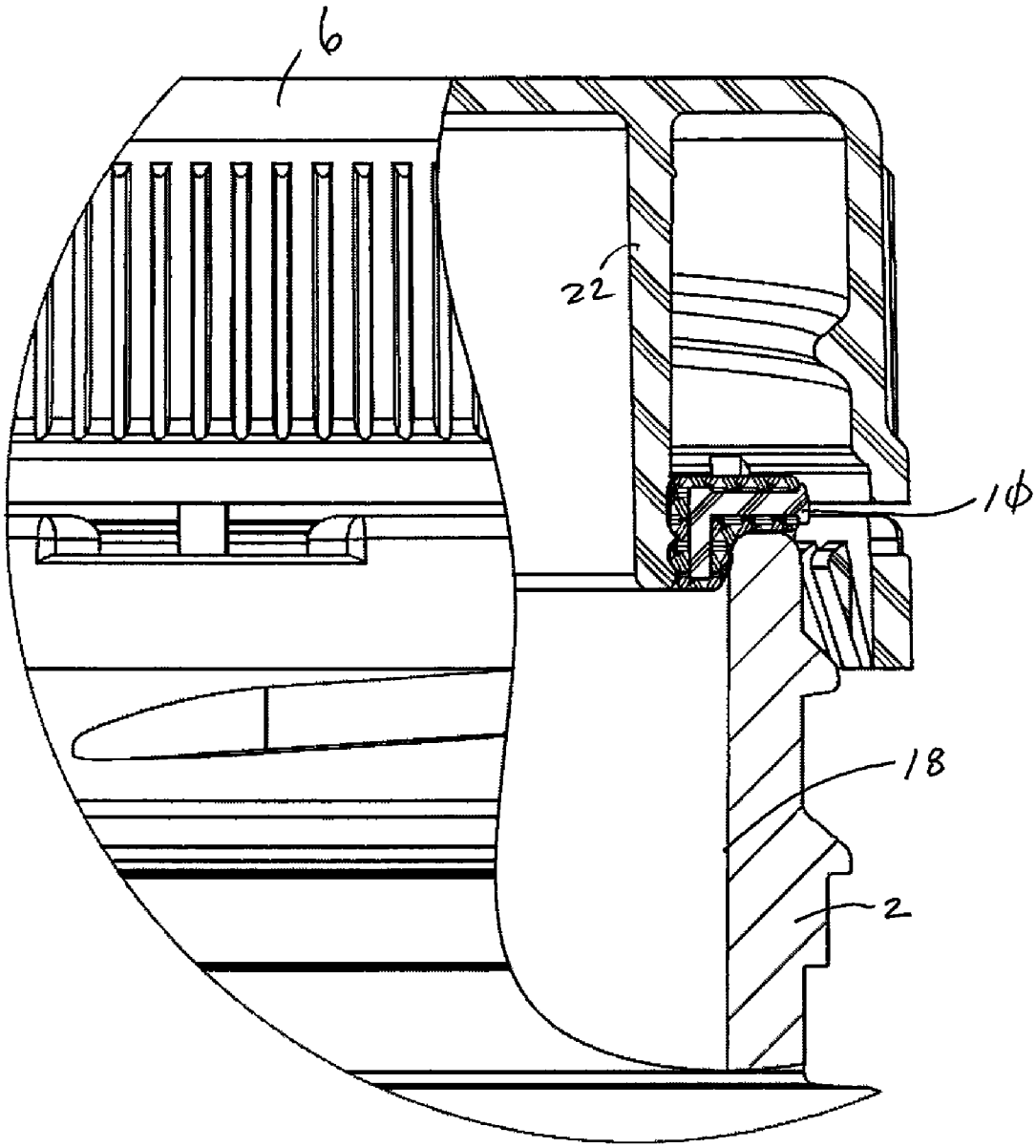
FIG. 1 depicts one embodiment of the present invention that utilizes a sealing slider ring wherein a cap is shown initially engaged on a container neck.

To assist in the understanding of the present invention the following list of components and associated numbering found in the drawings is provided herein:

| # | Component |
|---|---|
| 2 | Container neck |
| 6 | Cap |
| 10 | Slider ring |
| 14 | Inner surface |
| 18 | Inner surface of the neck |
| 22 | Interior portion |
| 26 | Bellows |
| 30 | Sealing mechanism |
| 34 | Headspace |
| 38 | Container outer surface |
| 42 | Container top surface |
| 46 | Container thread |
| 100 | Closure |
| 102 | Closure Upper End |
| 104 | Skirt Portion of Closure |
| 110 | First seal element |
| 112 | Second seal element |
| 114 | Seal Retention Feature |
| 116 | Seal Retention Leg |
| 118 | Seal Retention Arm |
| 120 | Upper Surface of Seal Retention Arm |
| 122 | Lower Surface of Seal Retention Arm |
| 124 | Retaining Lip |
| 126 | Closure Internal Thread System |
| 128 | Closure Skirt Projection |
| 130 | Inner Top Surface of Closure |
| 132 | Inner Skirt Surface of Closure |
| 134 | Lower End of Seal Retention Leg |
| 136 | First Sealing Groove |
| 138 | Second Sealing Groove |
| 140 | First Seal |
| 142 | Second Seal |
| 144 | Fully Seated Closure Position |
| 146 | First Side of Retention Leg |
| 148 | Second Side of Retention Leg |

-continued

| # | Component |
|---|---|
| 300 | Cap |
| 304 | Diaphragm |
| 308 | Side wall |
| 312 | Main panel |
| 316 | Inner surface |
| 320 | Fin |
| 324 | Head portion |
| 328 | Threads |
| 332 | Threads |
| 336 | T/E band |
| 340 | Bridge |
| 344 | T/E catch |
| 348 | Grip |
| 352 | Gap |
| 356 | Upper catch |
| 360 | Lower catch |
| 364 | Inner skirt |
| 368 | Outer skirt |
| 372 | Convolution |
| 376 | Seal |
| 380 | Catch ring |
| 384 | Vent |
| 388 | Rebound disk |
| 392 | Neck |
| 396 | Inner portion |
| 400 | Inclined surface |
| 404 | Air |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Figure 2:
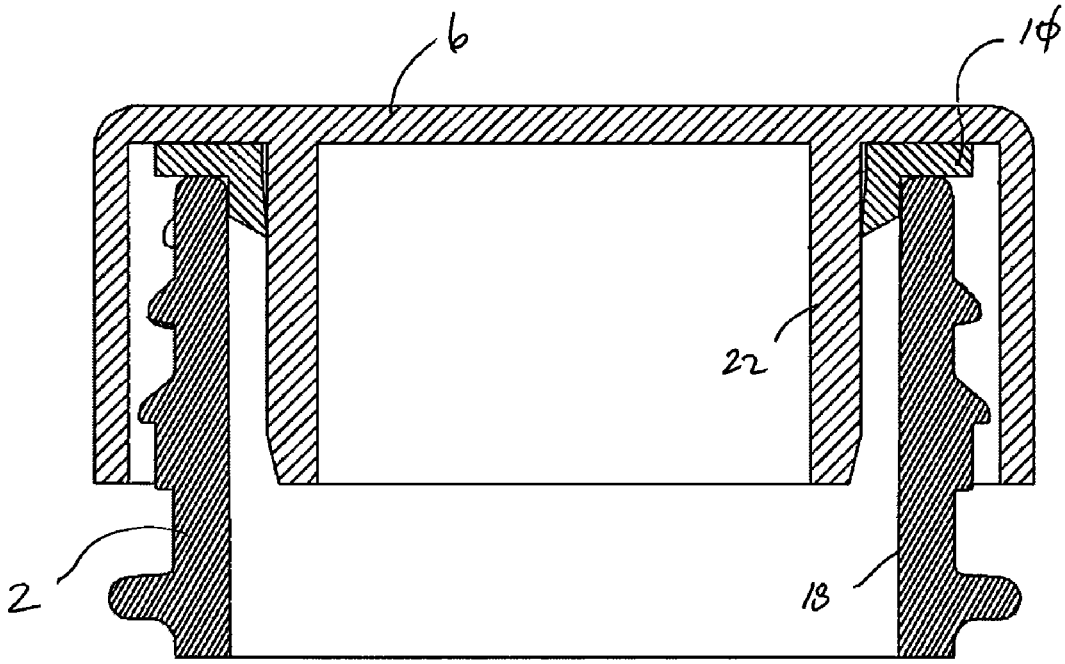
FIG. 2 shows the embodiment of FIG. 1 wherein the cap is shown fully interconnected to the container neck.
Figure 3:
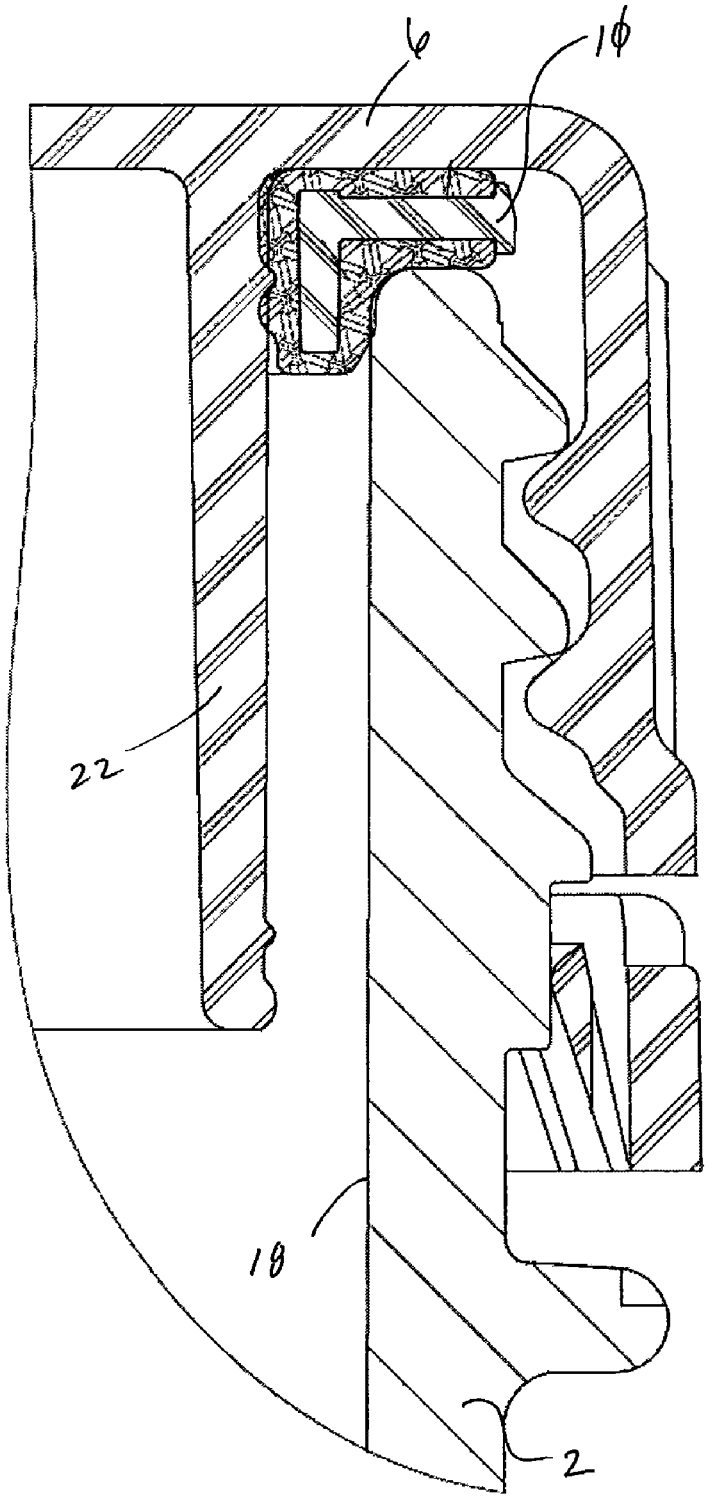
FIG. 3 is a detailed view of FIG. 2.

Referring now to the drawings, FIGS. 1-3 depict a closing sequence for one embodiment of the present invention. More specifically, a neck 2 of a plastic bottle is shown with a threaded cap 6 positioned on an uppermost portion. A sealing ring 10 that seals the cap 6 to the neck 2 during the closing sequence is also shown. In operation, the cap 6 is placed on the neck portion 2 of the container after the container is hot-filled with a beverage. A seal is created by the sealing ring 10 to prevent the escape of gas located between the fluid and the inner surface 14 of the threaded cap 6. As the cap 6 is rotated, the air between the inner surface 14 and the fluid (i.e., headspace) is pressurized. The seal formed between the interior 18 of the neck 2 of the container and the sealing ring 10 positioned on the interior portion 22, or fin of the cap 6. As the cap 6 is screwed downward, the seal between the neck 2 and the cap 6 prevents any gas from escaping, and a positive pressure is created within the headspace of the container.

Figure 4:
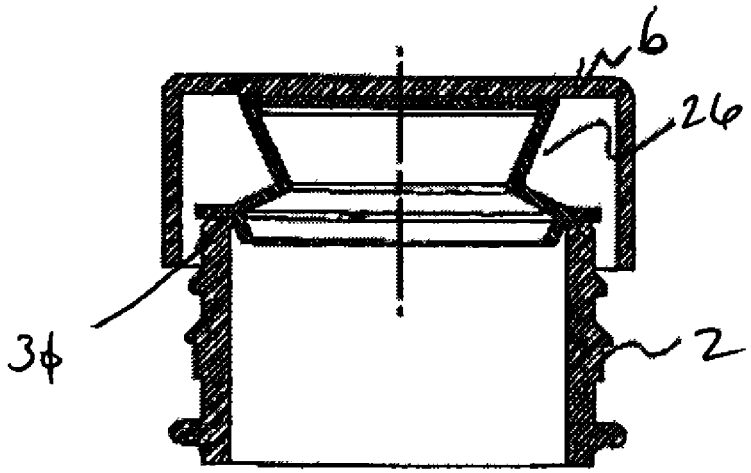
FIG. 4 depicts another embodiment of the present invention that utilizes a bellows shown initially contacts the container neck.
Figure 5:
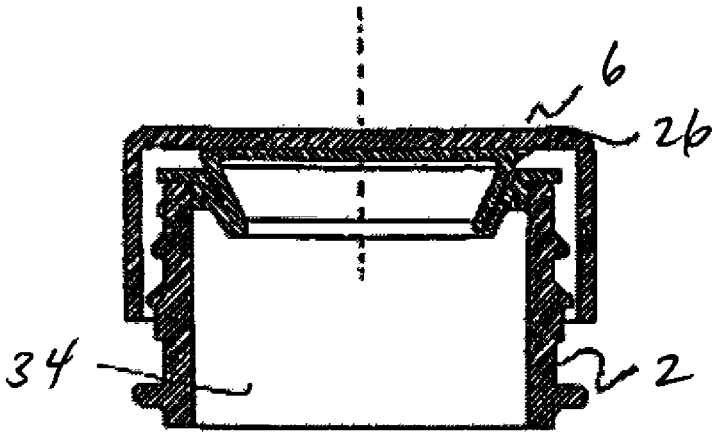
FIG. 5 shows the embodiment of FIG. 4 wherein the cap is shown fully interconnected to the container neck.

Referring now to FIGS. 4 and 5, a pressure compensating member in the form of a bellows 26 is shown. More specifically, the neck 2 of a plastic bottle is shown with the threaded cap 6 positioned on an uppermost portion. The cap 6 includes a bellows system 26 with a sealing mechanism 30 at one end thereof. In operation, the cap 6 is placed on the neck portion 2 of the container after the container is hot-filled with a beverage. Upon contact the seal 30 is created that prevents the escape of gas located in the headspace 34. As the cap 6 is rotated, the bellows 26 is compressed and forces the air therein into the headspace 34. The seal 30 is formed between the interior of the neck 2 of the container and the bellows 26 positioned on one end of the bellows 26. As the cap is screwed onto the neck 2, the seal 30 between the neck 2 and the bellows 26 prevents any gas from escaping, and a positive pressure is created within the headspace 34.

Figure 6:
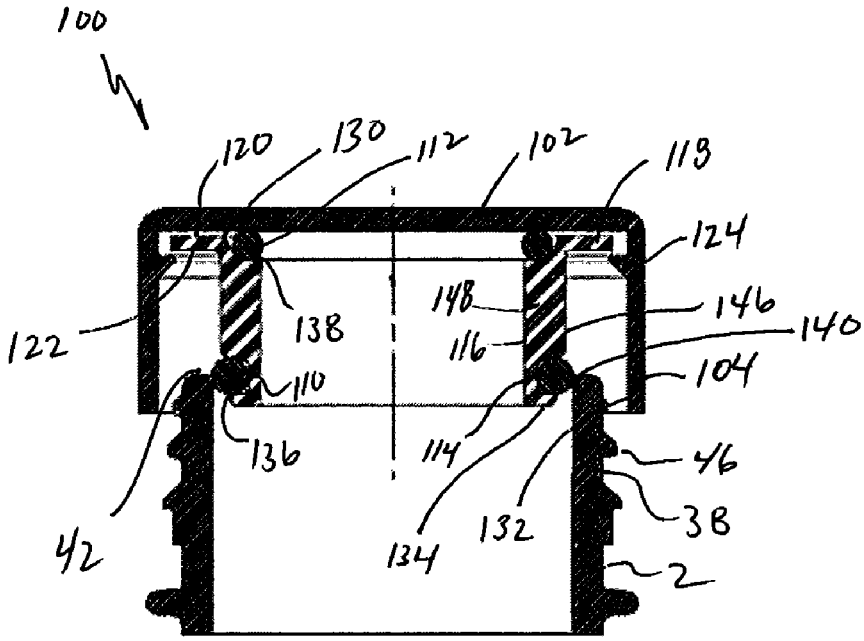
FIG. 6 is a partial cross-sectional view of the cap of another embodiment of the present invention shown positioned on a container neck prior to sealing.
Figure 7:
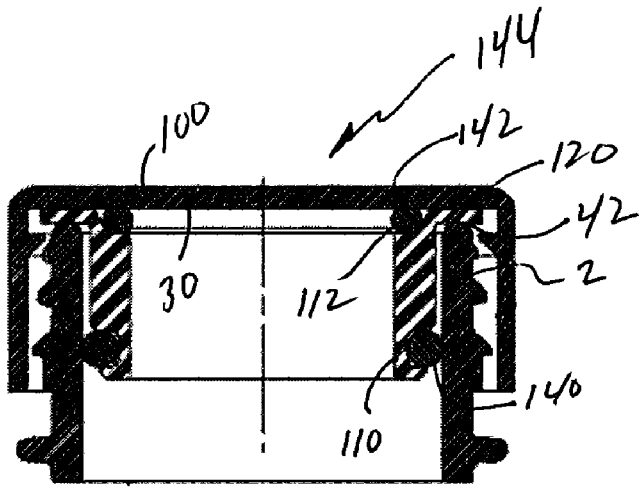
FIG. 7 is a partial cross-sectional view of the cap shown in FIG. 6 fully interconnected to a container neck.
Figure 8:
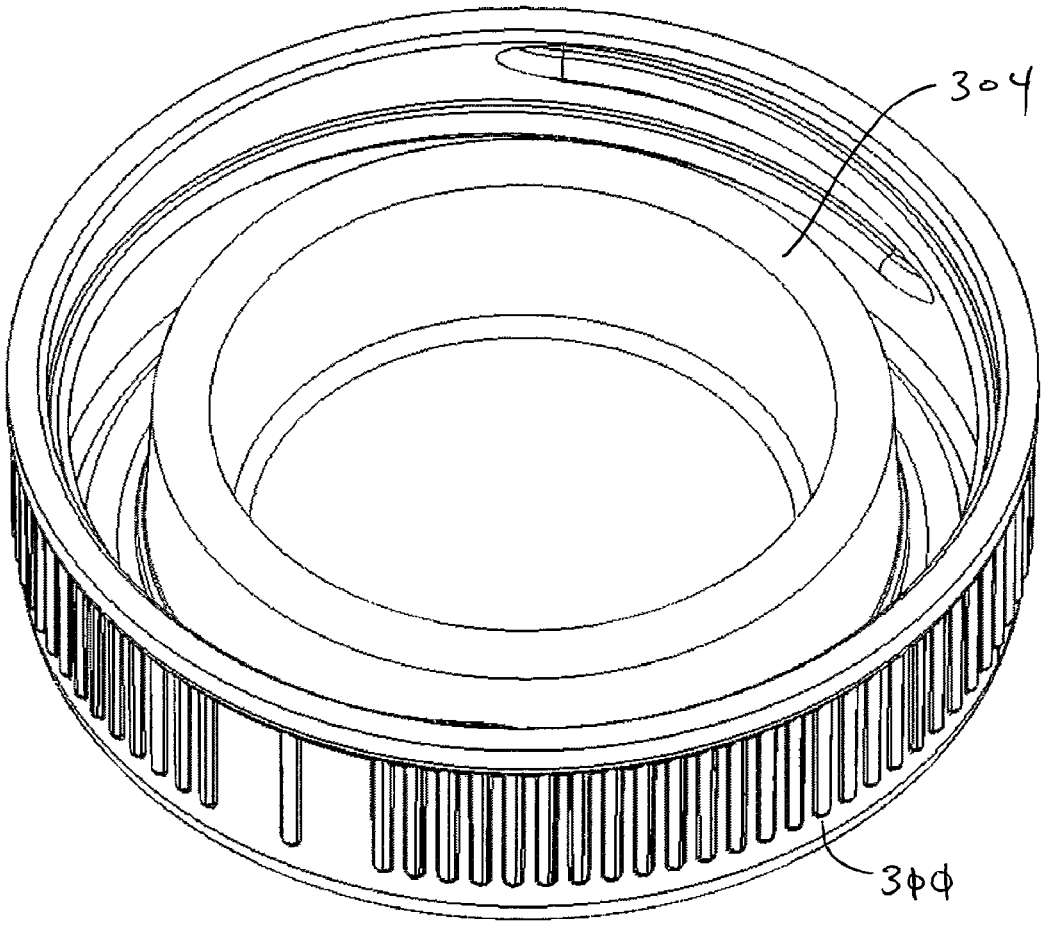
FIG. 8 is a bottom perspective view of a cap of another embodiment of the present invention that employs a selectively deflectable diaphragm.

Referring now to FIGS. 6 and 7, a threaded cap 100 representing another embodiment of the present invention is shown. More specifically, the cap 100 is comprised of an upper end 102 with a skirt portion 104 extending therefrom, and may include an anti-pilfer band interconnected to the skirt 104 by a score line. The cap 100 is may be comprised of a plastic material, preferably, an injection moldable thermoplastic plastic material having oxygen barrier properties. Alternatively, the cap may be comprised of metallic materials or a combination thereof.

A seal retention feature 114 positioned substantially concentrically within the plastic closure cap 100, and held within the cap 100 by a retaining lip 124 and a closure upper end 102. In one embodiment, the seal retention feature 114 includes a seal retention arm 118 and a seal retention leg 116. The seal retention leg 116 has a lower end 134, a first side 146 and opposing second sides 148. The seal retention arm 118 has an upper surface 120 and lower surface which generally oppose each other. The seal retention arm 118 and seal retention leg 116 can be separate and distinct elements which are joined together to form the seal retention feature 114, or the seal retention arm 118 and leg 116 leg can be elements of the seal retention feature 114. In one embodiment, the cross-section of the retention feature 114 can resemble an inverted letter "L". The retention feature 114 can be any polymeric material, preferably, a plastic material capable of being injected molded. More preferably, the polymeric material is a thermal plastic having oxygen barrier properties, or a material having thermoplastic properties, that can be injected molded.

In a one embodiment, first 110 and second seal elements 112 are operably interconnected to the retention feature 114. The first seal element 110 is positioned in a first seating groove 136 on the retention leg 116 between an inner skirt surface 132 and the retention leg 116. Preferably, the first seal element 110 is positioned nearer the lower end 134 of the seal retention leg 134 than the lower surface 122 of seal retention arm 118. The second seal element 112 is positioned in second seating groove 138 on the retention arm 118 between the inner top surface 130 and the retention arm 118. Preferably, the second seal element 112 is positioned nearer the retention leg 116 than the inner skirt surface 132.

In a preferred embodiment, the first seal element 110 and second seal element 112 are o-rings or other similar sealing devices well known in the art. More specifically the o-ring described herein is generally an elastomeric seal or gasket loop, with any variety of geometries and cross-sections which are designed to be seated in a groove and compressed between two or more parts to form a seal. The seal is maintained as long as the contact pressure of the o-ring exceeds the pressure being maintained by the o-ring. More specifically, the term "sealing device" generally means any compression fit device, wherein pressure cannot escape between the interior of the container and the cap seal.

The first seal element 110 and second seal element 112 are selected based on one or more of: chemical compatibility (with, for example, the plastic hot-fill container, the hot fill product, any lubricants, any adhesives, and any associated gases), temperature (such as, but not limited to, closure manufacturing, hot fill, post-fill, retail, and consumer-use temperatures), sealing pressure (that is, the pressure to form and maintain the seal), lubrication requirements (for the seal to slide along the container), food safety requirements (for example, governmental, agency, trade, and corporate), and cost.

The first seal element 110 and second seal element 112 can be any suitable thermoplastic polymer, thermoset rubber, or co-polymer or mixture thereof. Preferred thermoplastic polymers are generally: elastomer (TPE) styrenics; polyolefins (TPO), low density polyethylene (LDPE), high-density polyethylene (HDPE), linear low-density polyethylene (LLDPE), ultra low-density polyethylene (ULDPE); polyurethanes (TPU) polyethers and polyesters; etheresterelastomers (TEEEs) copolyesters; polyamides (PEBA); melt processible rubbers (MPR); vulcanizates (TPV); and mixtures and/or co-polymers thereof. Preferred thermoset rubbers are generally: butadiene rubber (BR); butyl rubber (IIR or PIB); chlorosulfonated polyethylene (CSM); epichlorohydrin rubber (ECH or ECO); ethylene propylene diene monomer (EPDM); ethylene propylene rubber (EPR); floroelastomers (FKM); nitrile rubber (NBR); perfluoroelastomer (FFKM); polyacrylate rubber (ASM); polycholorprene (CR); polyisoprene (IR); polysulfide rubber (PSR); silicon rubber (SiR); styrene butadiene rubber (SBR); and mixture and/or co-polymers thereof.

FIG. 6 depicts a neck of an associated container 2 which is filled with a hot-filled product wherein the cap 100 is initially positioned on the neck of the container. The neck 2 has opposing inner 18 and outer 38 surfaces, a top surface 42, and thread system 46. As shown, the closure cap 100 is positioned on the hot-fill container 2 prior to engagement of the closure cap 100 internal thread 126 and container threads (not shown). Prior to positioning the closure cap 100 on the container 2, the second sealing feature 112 is not in contact with the inner top surface 130.

After positioning the cap 100 on the neck of the container 2, a downward pressure is applied to the closure cap 100 to form a first seal 140 between the first seal element 110 and the inner surface 18. Likewise, the applied pressure forms a second seal 142 between the second seal element 112 and the inner top surface 130. One or more of the first 140 and second 142 seals creates a first headspace volume and first headspace pressure by hermetically sealing the closure 100 to the container 2.

Following or occurring about simultaneously with the formation of the first 140 and second 142 seals, the internal thread 126 and thread 46 systems are engaged by rotating the cap 100. As the rotation continues, the inner surface 130 advances towards container top surface 42, decreasing the headspace volume. Decreasing the headspace volume increases the headspace pressure within container 2 (which can be understood and calculated by one or more of the gas laws of Charles, Boyle and Gay-Lussac).

The closure cap 100 is rotated until the closure cap 100 is fully seated on the container 2, fully sealing the container 2 as depicted in FIG. 7. In the fully seated position 144, the upper surface 120 is adjacent to the inner top surface 130 and the top surface 42 is adjacent to the lower surface 122. The fully sealed container has a second headspace volume significantly less than the first headspace volume and a second headspace pressure significantly greater than the first headspace pressure. The fully sealed container can experience a variety of temperatures during storage, shipment, retail displace, and consumer-use. Typically, the minimum temperature experienced is about 40 degrees Fahrenheit, when the sealed container is refrigerated.

It should be appreciated that any temperature change may affect the headspace pressure and a reduction in temperature will decrease the headspace pressure. When the headspace pressure decreases sufficiently to create a vacuum, the hot-fill plastic container can distort. The distortions can be obviated by having the seating of cap 100 on the container 2 generate a sufficiently large headspace pressure to compensate for the decrease in headspace pressure when the container 2 is refrigerated. Thus, the headspace pressure within container 2 is sufficiently large that any decrease of the headspace pressure during cooling or refrigeration will not distort the structural geometric integrity of the plastic container. Thus, a headspace pressure can be generated which is sufficiently large that the container need not have reinforced panels and/or a flexible base to resist distortion during cooling. It is further appreciated that, the second headspace pressure needed to avoid container distortions can be calculated by the ideal gas law (or gas laws of Charles, Boyle, and/or Gay-Lassac).

As appreciated by one skilled in the art, the headspace pressure may be altered by at least one or more of the following: the degree to which the container is filled; the initial headspace temperature; the diameter and height of the cap; the dimensions and shape of the container; the physical properties of the container; the physical properties of the material comprising the container; the dimensions and shape of the container neck; the placement of the sealing features (or slider) within the cap; the lowest temperature the sealed container is exposed to and the composition of the gas and/or liquid in the container or headspace.

When the cap 100 is rotated to remove the cap from the container, the retention feature 114 contacts the retention lip 124 separating the second seal element 112 and inner top surface 130, creating a void volume between element 112 and surface 130. That is, the second seal element 112 and inner top surface 130 are no longer in contact and the second seal 142 no longer exists. When the seal breaks, the cap can subsequently be removed with a reduction in force. Likewise, in the closure removal process, the first seal element 110 and the inner surface 18 are separated by a void and the first seal 140 no longer exists.

Referring now to FIGS. 8-21, yet another embodiment of a cap 300 is shown that employs a selectively deformable diaphragm 304. The cap 300 also includes a sidewall 308 that depends from a main panel 312. The main panel 312 has an inner surface 316 with a plurality of fins 320 extending therefrom. In one embodiment of the present invention a resiliently deflectable diaphragm 304 is positioned such that in a first position of use a head portion 324 thereof rests against the inner surface 316 of the cap 300. In a second position of use the head portion 324 is positioned in a lower position in a direction toward the stored fluid.

Figure 9:
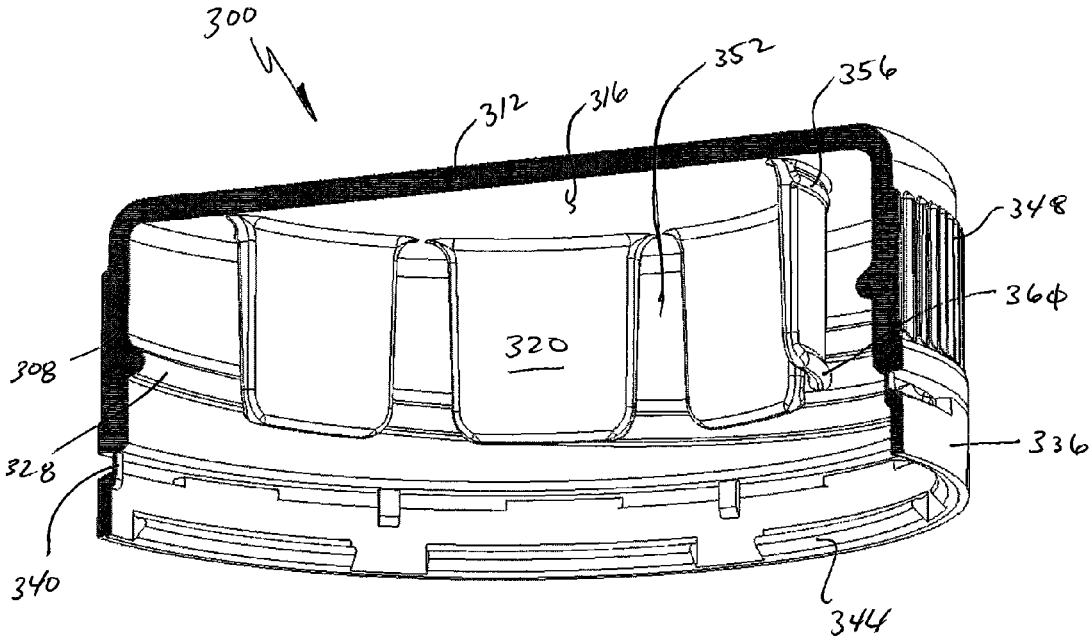
FIG. 9 is a cross-sectional perspective view of the cap shown in FIG. 8 wherein the diaphragm has been omitted for clarity.

Referring now to FIG. 9, a cross-sectional view of the cap 300 is shown that comprises the main panel 312 with sidewall 308 extending therefrom. The sidewall 308 includes internally disposed threads 328 for selective engagement with threads 332 of a container neck (see FIG. 17, for example). The sidewall 308 also includes the position for attachment of a tamper evidence ("T/E") band 336 (e.g., Pilfer Proof) via a bridge 340. The T/E band 336 is used as a visual indicator that the cap has been loosened from the neck. The T/E band 336 also includes a T/E catch 344 that maintains the T/E band 336 on the container neck after the cap 300 is removed or twisted such that one or more of the bridge members 340 break. In order to facilitate twisting of the cap 300 the sidewall 308 may include a plurality of gripping members 348. Extending from the inner surface 316 of the cap are the plurality of fins 320 that are spaced such that gaps 352 are provided therebetween. The fins 320 also include, in one embodiment of the present invention, an upper catch 356 and a lower catch 360 that selectively position the diaphragm which will be described in further detail below.

Figure 10:
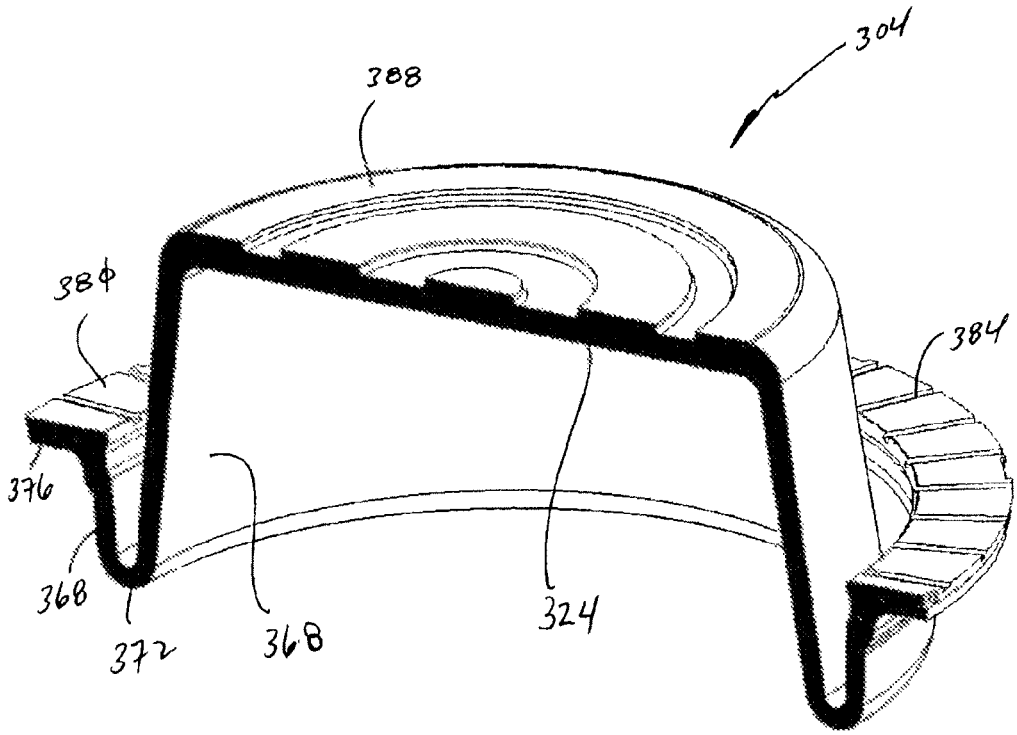
FIG. 10 is a cross-sectional perspective view of the diaphragm shown in FIG. 8.

Referring now to FIG. 10, the diaphragm 304 of one embodiment of the present invention is shown. Preferably, the diaphragm 304 is a shaped piece of resiliently deflectable material such as polyethylene, polypropylene, or other similar plastic materials. One skilled in the art, however, will appreciate that other flexible materials can be used without departing from the scope of the invention. The diaphragm 304 includes an inner skirt 364 positioned inwardly from an outer skirt 368 with a convolution 372 therebetween. The outer skirt 368 includes a flange or sealing surface 376 interconnected thereto. A catch ring 380 is either integrally molded onto the seal 376 and/or outer skirt 368 or interconnected to the seal 376. The catch ring 380 employs at least one vent 384 to allow air to pass from a location beyond an outer surface of the seal 376 to a position between the inner skirt 364 and the outer skirt 368. Preferably, the diaphragm 304 has a generally flat head portion 324 that is pulled downwardly when the pressure of the fluids stored within the sealed container decreases. In one embodiment of the present invention a rebound disk 388 (or ring) is generally interconnected to the head portion 324 of the diaphragm 304 that is generally rigid and facilitates movement of the head to its upward position when the sealed container is open.

Figure 11:
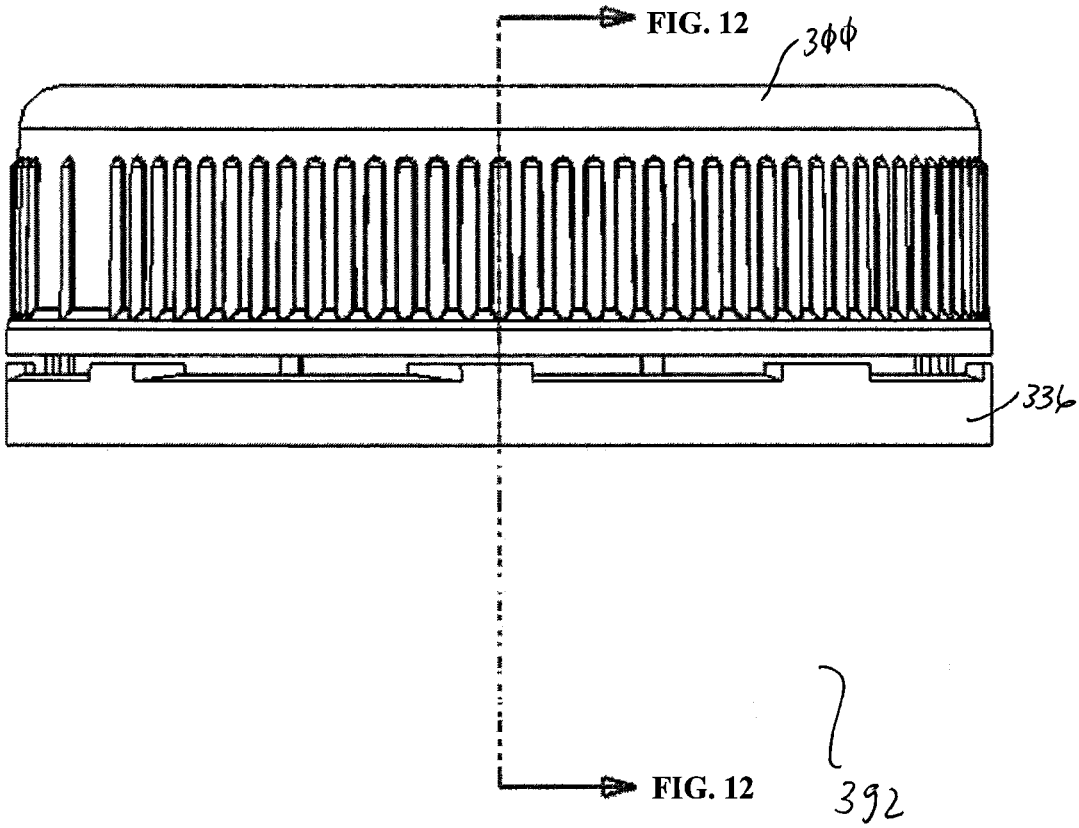
FIG. 11 is a front elevation view of the cap of FIG. 8 shown initially engaged on a container neck.
Figure 12:
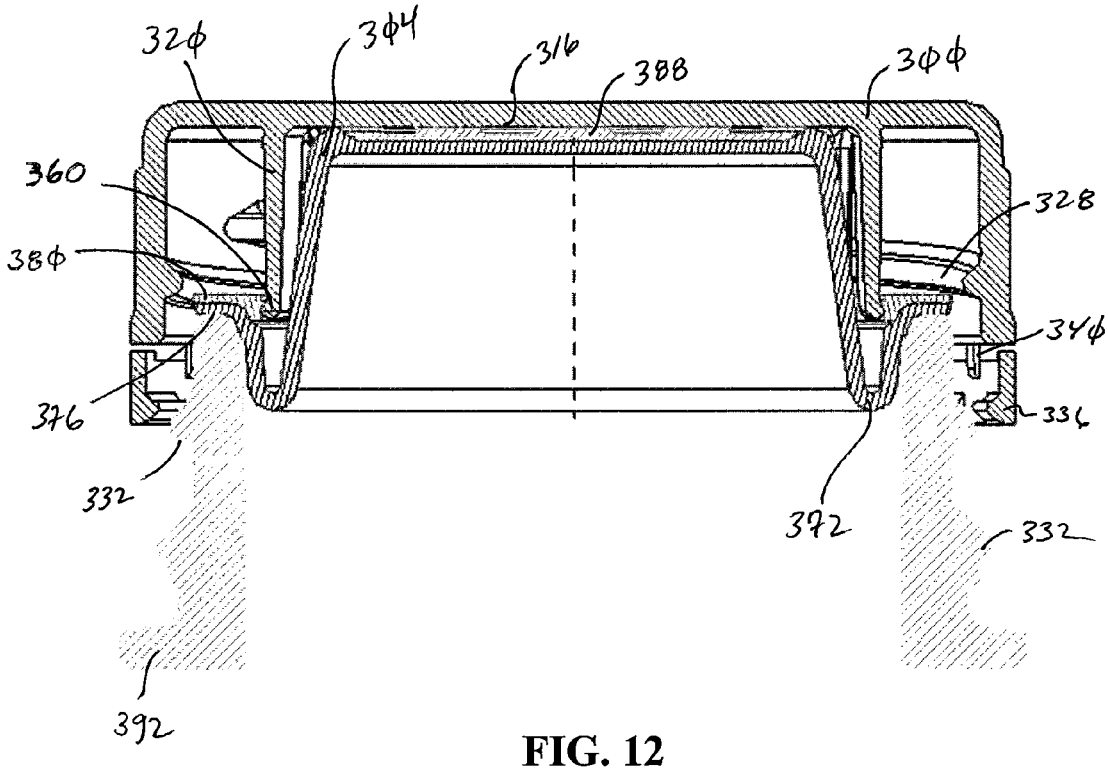
FIG. 12 is a front cross-section of FIG. 11, wherein the diaphragm is shown positioned in a first position of use.
Figure 13:
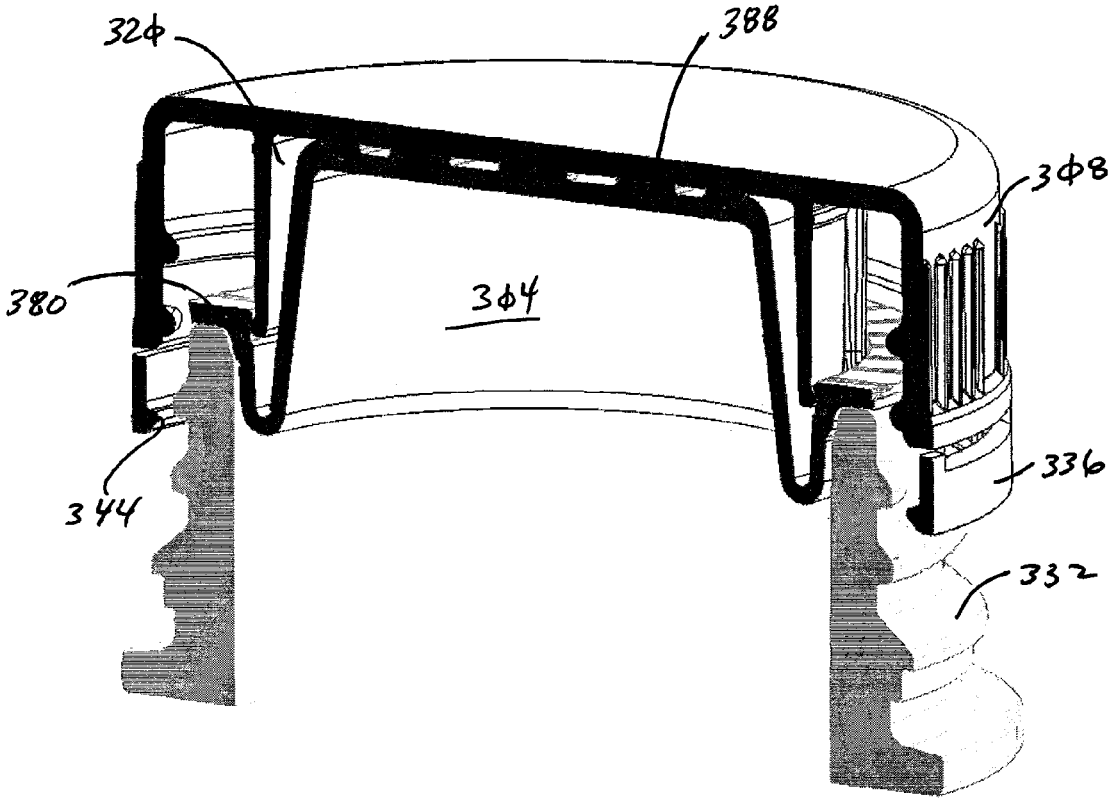
FIG. 13 is a perspective view of FIG. 12.

Referring now to FIGS. 11-13, the cap 300 of the present invention with a diaphragm 304 is shown interconnected to the neck 392 of a container. As illustrated, the seal 376 is engaged to a top portion of the neck 392. In FIG. 11, the cap 300 is shown prior to tightening onto the neck 392. Prior to tightening, the seal 376 is placed onto the top portion of the neck 392 wherein the seal 376 is positioned between the catch ring 380 and the neck 392. The rebound disk 388 of the embodiment shown is positioned against an inner surface 316 of the cap 300. As the cap 300 is rotated, the threads 328 of the cap will come in contact with the threads 332 of the neck 392 to transition the cap 300 downwardly onto the neck 392. Rotating the cap will move the fin 320 downwardly to contact the convolution 372 of the diaphragm 304. Further, as the cap is rotated a "pre-pressure", or air volume is added to the headspace of the container. Thus, the headspace pressure can be increased during the closure of the container as the cap is screwed to the neck of the container.

Figure 14:
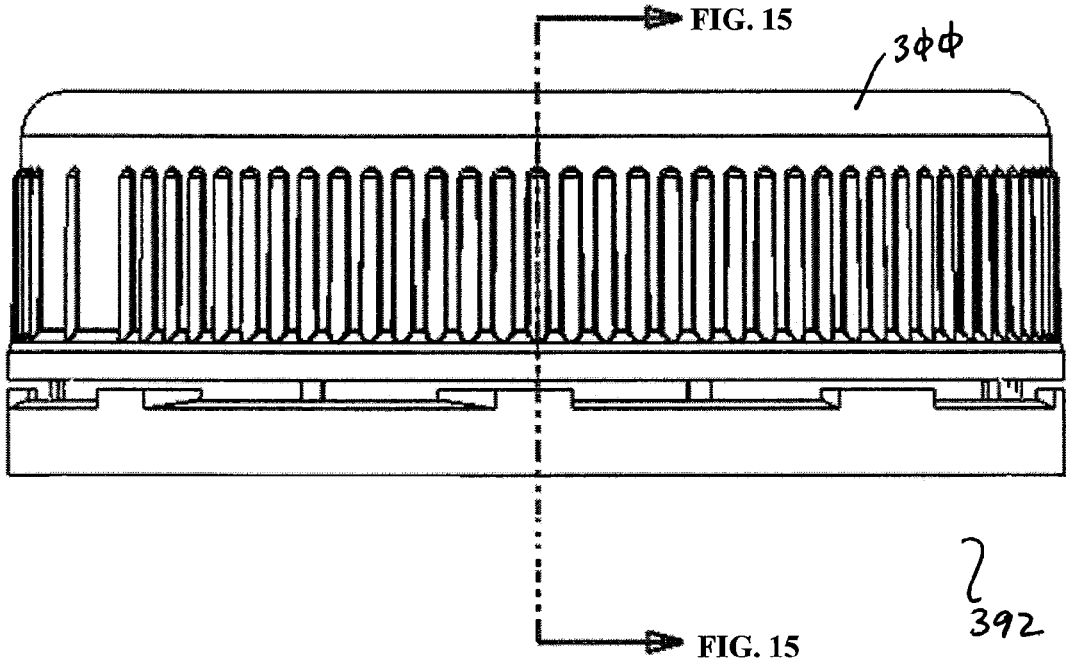
FIG. 14 is a front elevation view of the cap of FIG. 8 shown completely sealed onto a container neck.
Figure 15:
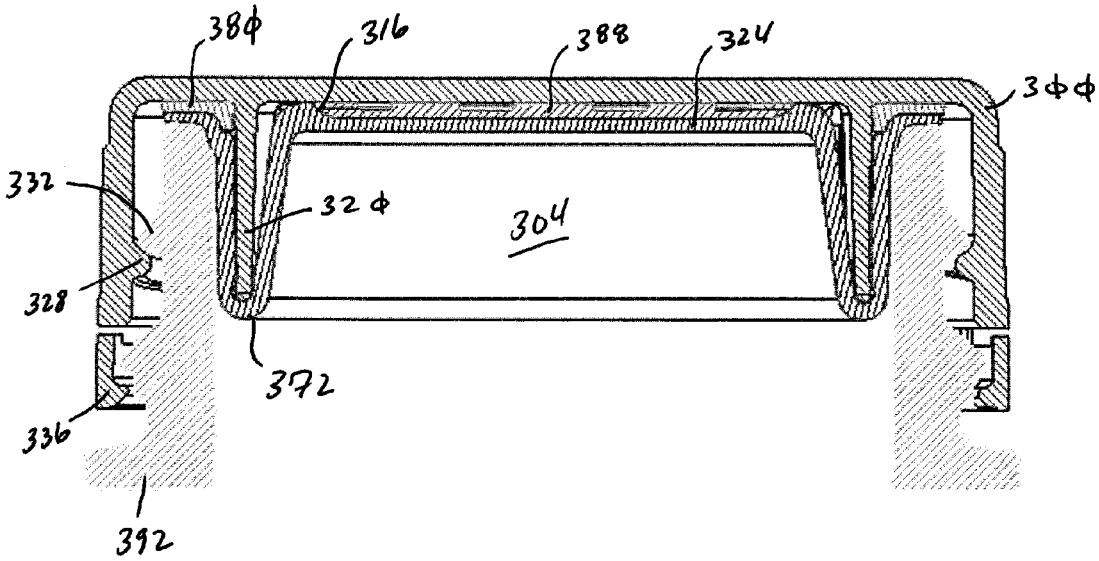
FIG. 15 is a front cross-section of FIG. 14, wherein the diaphragm is shown positioned in a first position of use.
Figure 16:
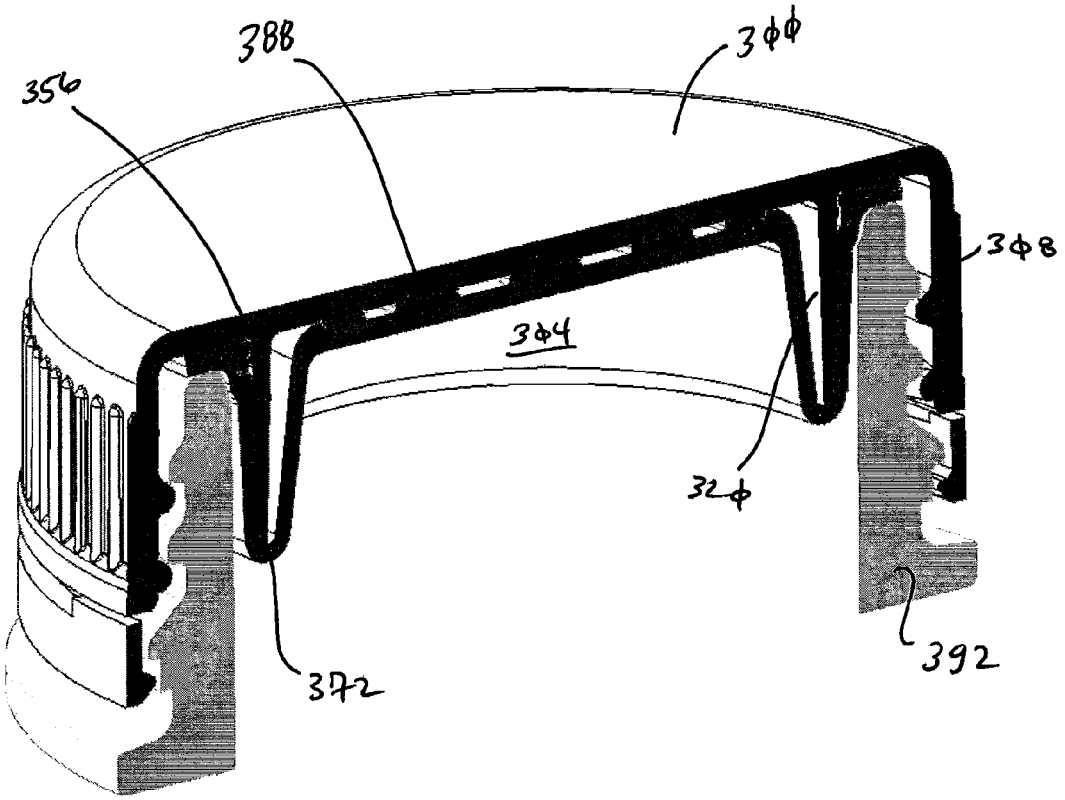
FIG. 16 is a perspective view of FIG. 15.
Figure 17:
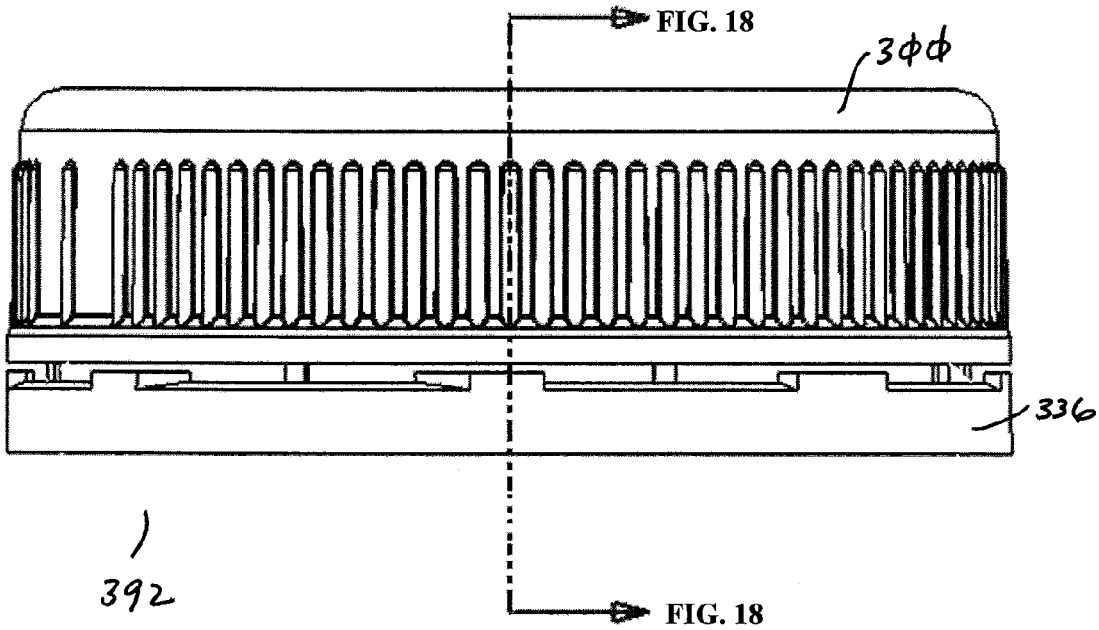
FIG. 17 is a front elevation view of the cap of FIG. 8 shown completely interconnected to the container neck.
Figure 18:
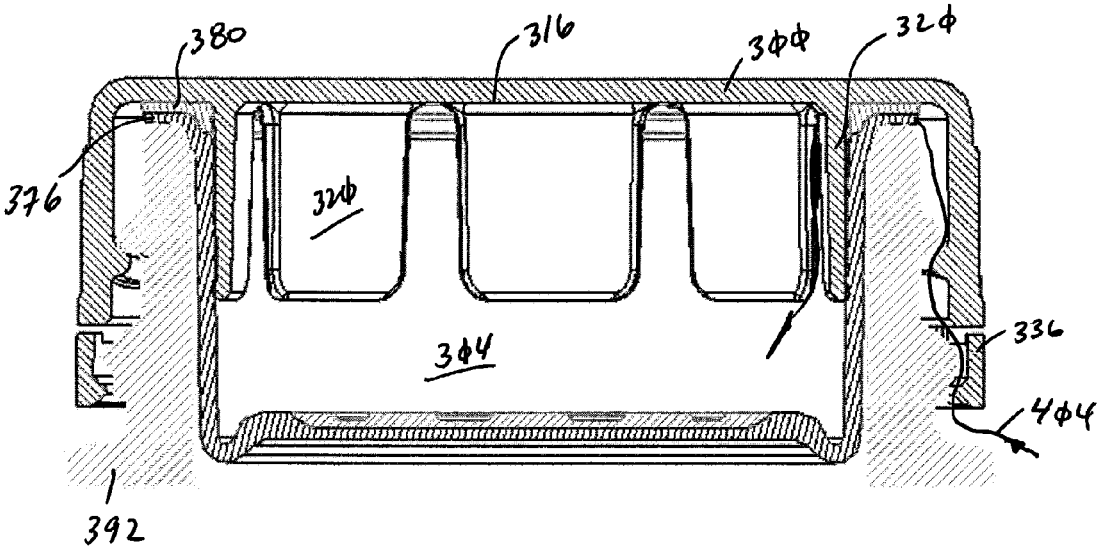
FIG. 18 is a cross-sectional view of FIG. 17 wherein the diaphragm is shown in a second position of use, thereby accommodating a pressure decrease in the sealed container.
Figure 19:
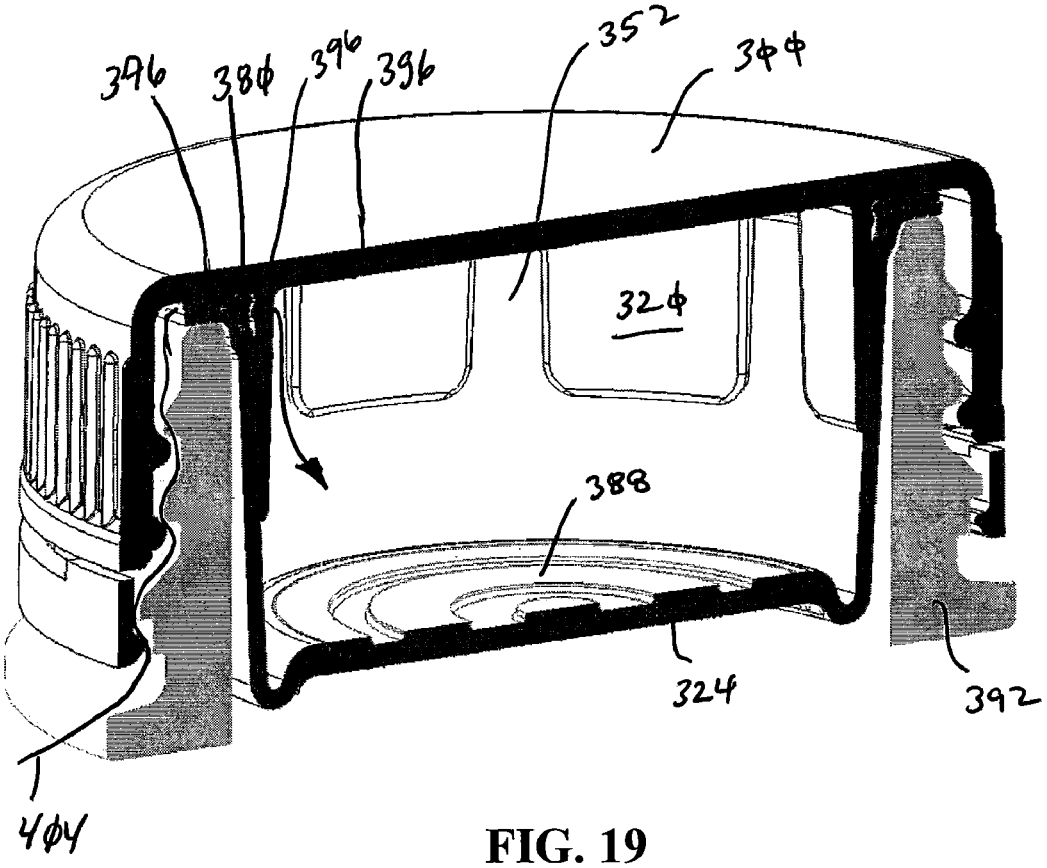
FIG. 19 is a perspective view of FIG. 18.

FIGS. 14-19 illustrate the cap 300 sealingly engaged on the container neck 392 with the heated liquid therein. FIGS. 14-16 show the cap 300 completely tightened onto the container neck 392 wherein the diaphragm 304 is in a first position of use prior to the cooling of the liquid product. FIGS. 17-19 shows the affect of content cooling on the diaphragm 304. To seal the container, the cap 300 is placed on the neck 392 such that the seal 376 rests on the upper end of the container neck 392. The catch ring 380, which is integrated or otherwise affixed to the seal 376 is also positioned over the upper surface of the container neck 392. As the cap 300 is rotated onto the container neck 392, the fins 320 will transition downwardly to contact the convolution 372 of the diaphragm 304. As this happens, the upper catch 356 of the fin 320 will deflect an inner portion 396 of the catch ring 380 and transition thereby. More specifically, the upper catch ring 380 includes an inclined surface 400 that facilitates the upper catch ring's 380 transitions past the inner portion 396 of the catch ring 380. Thereafter, the catch ring 380 is prevented from moving relative to the main panel 312 of the cap 300, and is maintained relative thereto.

Figure 20:
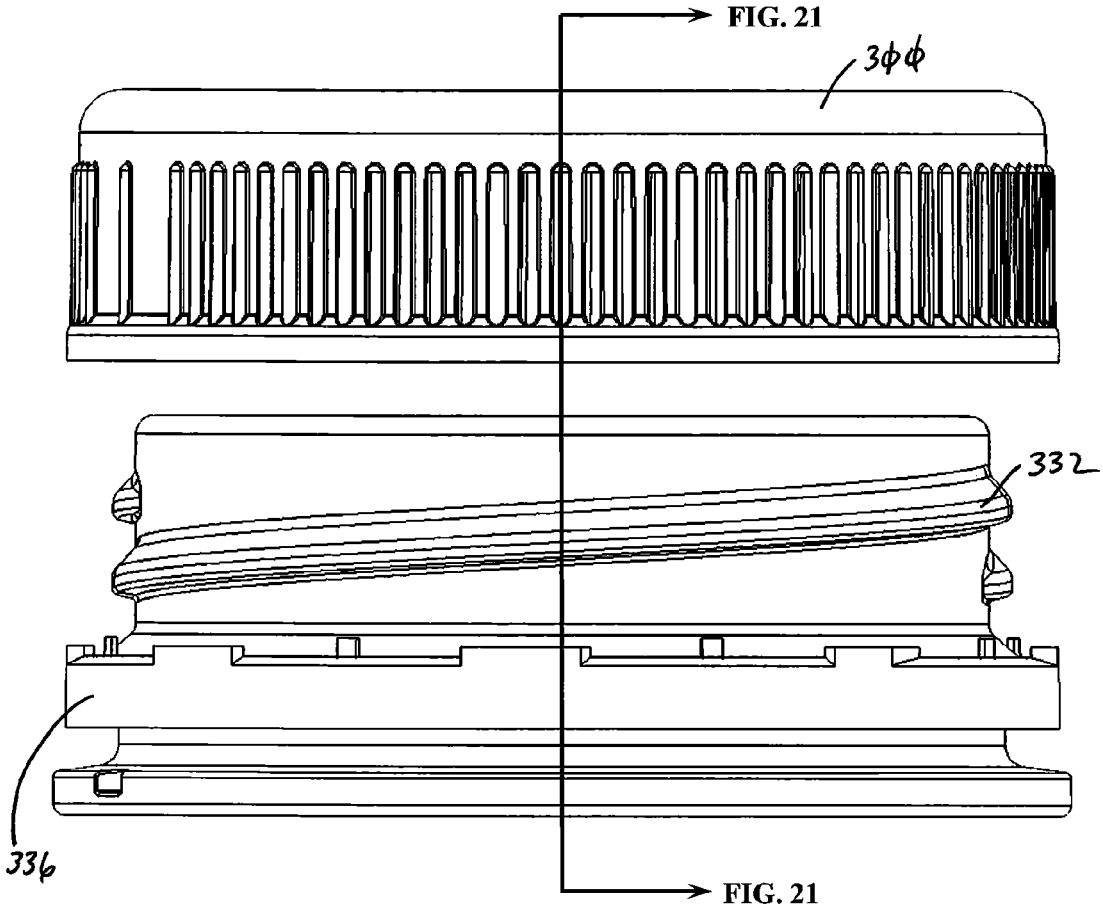
FIG. 20 is a front elevation view of the cap shown in FIG. 8 shown removed from the container neck.
Figure 21:
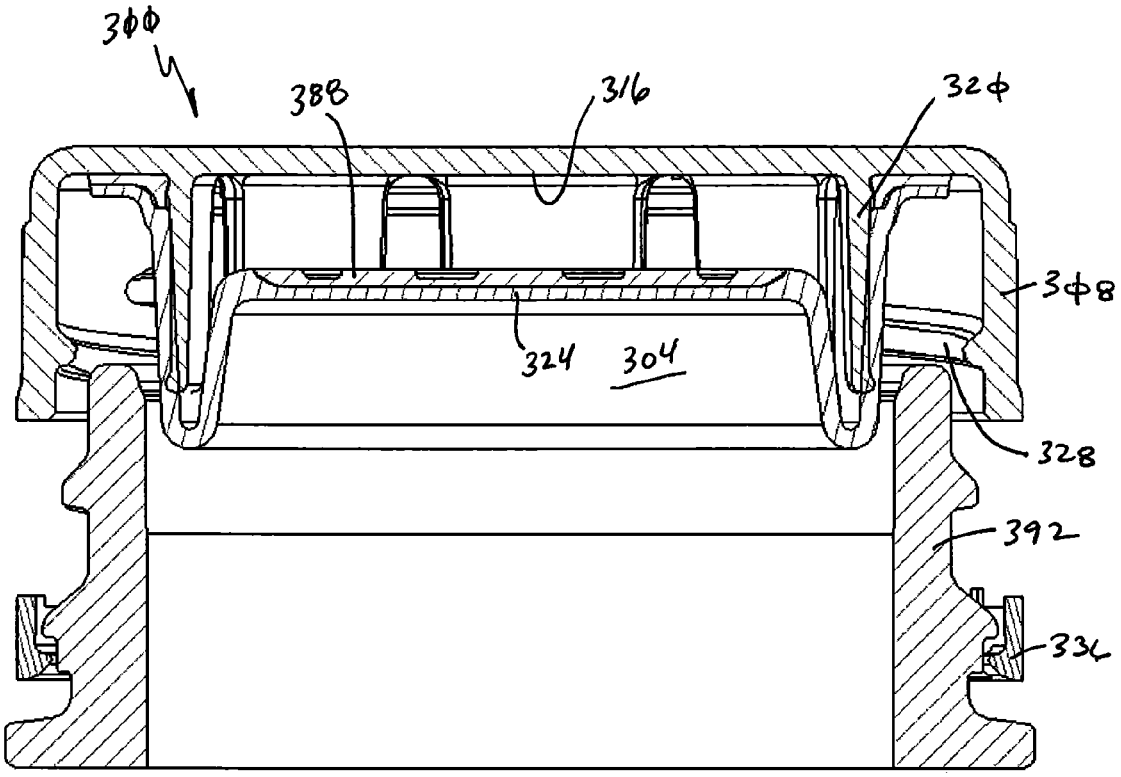
FIG. 21 is a cross-sectional view of FIG. 20 wherein the diaphragm has rebounded to its first position of use.

Referring now to FIGS. 20 and 21, in operation the diaphragm 304 is designed to transition downwardly when the stored product in the container cools. In order to facilitate this downward motion, air from the external environment travels through the threads of the neck 332, through the vents 384 in the catch ring 380 and through the gaps 352 of the fins 320. This air 404 enters a space between the main panel 312 of the cap and the head of the diaphragm 304, provided by the pressure drop, thereby equalizing the pressure inside and outside the container. As one skilled in the art will appreciate, if the contents of the container should subsequently heat up, the pressure of the stored fluids within the container will increase and force the diaphragm 304 upwardly, thereby transitioning air from between the space through the gaps 352 in the fins, through the catch ring vents 384 and subsequently through the threads. The transfer of air into the container is more commonly seen when the cap 300 is removed from the container.

More specifically, the cap 300 is rotated in a direction opposite from tightening. As the cap 300 is rotated, the catch ring 380 and associated seal 376 are pulled away from the upper surface of the neck 392, which allows any pressure differential or vacuum within the container to be quickly equalized. The pressure equalization removes the force that pulls the diaphragm 304 downwardly as seen in FIGS. 18 and 19. The diaphragm 304 is then able to return to its first position of use as shown in FIG. 12. In order to facilitate this return, a rebound disk 388 that is interconnected to the head portion 324 of the diaphragm 304 is provided. The rebound disk 388 is made of a stiffened material that is radially loaded by an inner wall of the diaphragm 304 when it is pulled downwardly. The rebound disk 388 also keeps the head of the diaphragm 304 substantially planar to allow for even pressure distribution across the same. When the pressure differential is removed, the potential energy stored within the rebound disk 388 is released to aid the resilient nature of the diaphragm 304 to return it to its first position. Also note that the catch ring 380 and seal 376 after removal of the cap 300 remains adjacent to the inner surface 316 thereof.

The foregoing discussion of the invention has been presented for purposes of illustration and description. The foregoing is not intended to limit the invention to the form or forms disclosed herein. Although the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A cap adapted for selective interconnection to a neck of a plastic container, comprising:

a main panel with a threaded circumferential sidewall extending therefrom;

at least one fin extending from said main panel and operably spaced from said sidewall, said at least one fin further comprising at least one opening to allow the ingress and egress of ambient air during the closure of said cap;

a diaphragm having a head with an inner skirt extending therefrom that is interconnected, via a convolution, to an outer skirt, said outer skirt interconnected to a seal that is positioned between said sidewall and said at least one fin and which is adapted to engage an upper edge of the neck of the container;

wherein as said cap is rotated onto said neck of said container air is trapped below said diaphragm to create a positive pressure in a headspace of said container; and wherein said head of said diaphragm moves from a first position substantially adjacent to said main panel to a second extended position away from said main panel when a fluid within the container is cooled a predetermined amount.

2. The closure cap of claim 1, further comprising a catch ring interconnected to said seal that is adapted to move between a free end of said at least one fin and said main panel.

3. The closure cap of claim 1, further comprising a frangible band interconnected to said sidewall to indicate whether a seal between the cap and the container has been compromised.

4. The closure cap of claim 1, further comprising a disk interconnected to said head of said diaphragm, said disk having a stiffness greater than said diaphragm.

5. The closure cap of claim 2, wherein said catch ring includes at least one passageway that allows ambient air to pass from a space between said sidewall and said neck to a volume positioned above said diaphragm.

6. The closure cap of claim 2, wherein said at least one fin includes an upper catch positioned adjacent to said main panel and a lower catch positioned adjacent to said free end wherein prior to positioning said cap onto said neck, said catch ring is engaged onto said lower catch and subsequent to sealing said cap onto said neck, said catch ring is engaged adjacent to said upper catch.

7. The closure cap of claim 1, wherein said at least one fin comprises a plurality of fins with spaces positioned therebetween that define openings that allows the ingress and egress of ambient air.

8. The closure cap of claim 1, wherein said diaphragm is comprised of an impermeable material.

9. A closure system adapted to substantially reduce the vacuum pressure in a hot fill plastic bottle; comprising:

a rotatable cap comprised of:

a main panel with a threaded circumferential outer wall extending therefrom;

an inner wall extending from said main panel and spaced internally from said outer wall that includes at least one passageway which allows the ingress of ambient air below said main panel;

a diaphragm having a perimeter edge operably engaged to a catch ring and adapted to form a seal with an upper edge of a neck of said container, said diaphragm capable of moving between a first position which is substantially adjacent to said main panel and a second expanded position which is located away from said main panel;

wherein when said rotatable cap is tightened onto the neck of the container which is filled with a fluid at a first temperature, a seal is formed on an upper surface of the neck of the container wherein air is trapped within a headspace volume in the container and compressed to increase the internal pressure within the container; and wherein said at least one passageway allows the ingress of ambient air and expansion of said diaphragm from first position to a second position in response to the cooling of the liquid in the container to substantially prevent a vacuum within the container.

10. The closure system of claim 9, wherein said diaphragm comprises a head with an inner skirt extending therefrom that is interconnected, via a convolution, to an outer skirt, said outer skirt interconnected to an outwardly extending seal that is positioned between said outer wall and said inner wall.

11. The closure system of claim 9, further comprising a catch ring interconnected to said seal that is adapted to move between a free end of said inner wall and said main panel.

12. The closure system of claim 11, wherein said catch ring includes at least one passageway that allows gas to pass from a space between said sidewall and said neck to the inside of the container above said diaphragm.

13. The closure system of claim 9, further comprising a tamper evidence band interconnected to said outer wall.

14. A flexible, non-metallic hot fill beverage container and associated reclosable cap, comprising:

a container body having a base, a sidewall connected to said base and a neck interconnected to an upper portion of the sidewall;

a closure cap for selective interconnection to said neck of the plastic container, comprising:

a main panel with a threaded sidewall extending therefrom;

at least one fin extending from said main panel and operably spaced from said sidewall, said at least one fin forming a passageway to allow the ingress of ambient air;

a diaphragm having a head with an inner skirt extending therefrom that is interconnected to an outer skirt, said outer skirt interconnected on a perimeter edge to an outwardly extending seal that is positioned between said neck of said container and said at least one fin;

wherein as said cap is rotated onto said neck of said container air is trapped below said diaphragm to create a positive pressure in a headspace of said container; and wherein said head of said diaphragm moves from a first position located adjacent to said main panel to a second position located away from said main panel when a temperature of a fluid in the container is reduced a sufficient amount.

15. The beverage container of claim 14, wherein said container body is made of a plastic material.

16. The beverage container of claim 14, further comprising a catch ring interconnected to said seal that is adapted to move between a free end of said at least one fin and said main panel.

17. The beverage container of claim 16, wherein said catch ring includes at least one passageway that allows ambient air to pass from a space between said sidewall and said neck to a space below said main panel and above said diaphragm.

18. The beverage container of claim 14, further comprising a tamper evidence band interconnected to said sidewall of said reclosable cap.

19. The beverage container of claim 14, further comprising a disk interconnected to said head of said diaphragm, said disk having a rigidity greater than said diaphragm.

20. The beverage container of claim 14, wherein said at least one fin includes an upper catch positioned adjacent to said main panel and a lower catch positioned adjacent to said free end wherein prior to positioning said cap onto said neck, said catch ring is engaged onto said lower catch and subsequent to sealing said cap onto said neck, said catch ring is engaged adjacent to said upper catch.

21. The beverage container of claim 14, wherein pressure in the headspace of the container is increased as the closure cap is rotated and forced downward onto the neck of the container.

22. A closure system adapted to substantially reduce the vacuum pressure in a hot fill plastic bottle; comprising:

a rotatable cap comprised of:

a main panel with a threaded circumferential outer wall extending therefrom;

an inner wall extending from said main panel and spaced internally from said outer wall that includes at least one passageway which allows the ingress of ambient air below said main panel;

a diaphragm having a perimeter edge operably engaged to a catch ring and adapted to form a seal with an upper edge of a neck of said container, said diaphragm capable of moving between a first position which is substantially adjacent to said main panel and a second expanded position which is located away from said main panel;

wherein when said rotatable cap is tightened onto the neck of the container which is filled with a fluid at a first temperature, a seal is formed on an upper surface of the neck of the container wherein air is trapped within a headspace volume in the container;

wherein said at least one passageway allows the ingress of ambient air and expansion of said diaphragm from first position to a second position in response to the cooling of the liquid in the container to substantially prevent a vacuum within the container; and wherein the catch ring is interconnected to said seal that is adapted to move between a free end of said inner wall and said main panel.

23. A closure system adapted to substantially reduce the vacuum pressure in a hot fill plastic bottle; comprising:

a rotatable cap comprised of:

a main panel with a threaded circumferential outer wall extending therefrom;

an inner wall extending from said main panel and spaced internally from said outer wall that includes at least one passageway which allows the ingress of ambient air below said main panel;

a diaphragm having a perimeter edge operably engaged to a catch ring and adapted to form a seal with an upper edge of a neck of said container, said diaphragm capable of moving between a first position which is substantially adjacent to said main panel and a second expanded position which is located away from said main panel;

wherein when said rotatable cap is tightened onto the neck of the container which is filled with a fluid at a first temperature, a seal is formed on an upper surface of the neck of the container wherein air is trapped within a headspace volume in the container;

wherein said at least one passageway allows the ingress of ambient air and expansion of said diaphragm from first position to a second position in response to the cooling of the liquid in the container to substantially prevent a vacuum within the container; and wherein the catch ring includes at least one passageway that allows gas to pass from a space between said sidewall and said neck to the inside of the container above said diaphragm.

24. A closure system adapted to substantially reduce the vacuum pressure in a hot fill plastic bottle; comprising:

a rotatable cap comprised of:

a main panel with a threaded circumferential outer wall extending therefrom;

an inner wall extending from said main panel and spaced internally from said outer wall that includes at least one passageway which allows the ingress of ambient air below said main panel;

a diaphragm having a head and a perimeter edge operably engaged to a catch ring and adapted to form a seal with an upper edge of a neck of said container, said diaphragm capable of moving between a first position which is substantially adjacent to said main panel and a second expanded position which is located away from said main panel;

a disk interconnected to said head of said diaphragm, said disk having a stiffness greater than said diaphragm;

wherein when said rotatable cap is tightened onto the neck of the container which is filled with a fluid at a first temperature, a seal is formed on an upper surface of the neck of the container wherein air is trapped within a headspace volume in the container; and wherein said at least one passageway allows the ingress of ambient air and expansion of said diaphragm from first position to a second position in response to the cooling of the liquid in the container to substantially prevent a vacuum within the container.

25. A closure system adapted to substantially reduce the vacuum pressure in a hot fill plastic bottle; comprising:

a rotatable cap comprised of:

a main panel with a threaded circumferential outer wall extending therefrom;

an inner wall extending from said main panel and spaced internally from said outer wall that includes at least one fin having a free end and defining at least one passageway which allows the ingress of ambient air below said main panel;

a diaphragm having a perimeter edge operably engaged to a catch ring and adapted to form a seal with an upper edge of a neck of said container, said diaphragm capable of moving between a first position which is substantially adjacent to said main panel and a second expanded position which is located away from said main panel;

wherein said at least one fin includes an upper catch positioned adjacent to said main panel and a lower catch positioned adjacent to said free end wherein prior to positioning said cap onto said neck, said catch ring is engaged onto said lower catch and subsequent to sealing said cap onto said neck, said catch ring is engaged adjacent to said upper catch;

wherein when said rotatable cap is tightened onto the neck of the container which is filled with a fluid at a first temperature, a seal is formed on an upper surface of the neck of the container wherein air is trapped within a headspace volume in the container; and wherein said at least one passageway allows the ingress of ambient air and expansion of said diaphragm from first position to a second position in response to the cooling of the liquid in the container to substantially prevent a vacuum within the container.

* * * * *